United States Patent [19]

Deix

[11] 3,936,991

[45] Feb. 10, 1976

[54] BOTTLE STOPPERING APPARATUS

[75] Inventor: Jean Deix, Chalon-sur-Saone, France

[73] Assignee: Le Bouchage Mecanique, Paris, France

[22] Filed: Feb. 14, 1974

[21] Appl. No.: 442,620

[30] Foreign Application Priority Data

Feb. 22, 1973 France ..... 73.06260

[52] U.S. Cl. ..... 53/76; 53/315; 53/319

[51] Int. Cl.[2] ..... B65B 57/02; B65B 7/28

[58] Field of Search ..... 53/76, 75, 315, 319

[56] References Cited

UNITED STATES PATENTS

| | | | |
|---|---|---|---|
| 3,057,135 | 10/1962 | Weller | 53/315 |
| 3,559,365 | 2/1971 | Hull et al. | 53/76 X |
| 3,706,177 | 12/1972 | Willett | 53/76 |
| 3,708,951 | 1/1973 | Folk et al. | 53/75 |

*Primary Examiner*—Travis S. McGehee
*Attorney, Agent, or Firm*—Pennie & Edmonds

[57] ABSTRACT

A bottle stoppering machine includes a travelling belt which carries the bottles to be stoppered, a stopper distributor positioned over the belt, and a stopper driver also positioned over the belt at a position downstream of the distributor. To adjust the vertical separation of the belt and distributor according to undesired variations in the height of the bottles, a first detector detects the approach of a bottle to the distributor, second and third detectors detect excess or deficiency in the height of the approaching bottle, and servomechanism controlled by these detectors raises or lowers the belt at the position beneath the distributor, or alternatively raises or lowers the distributor, in response to the signals of the detectors to match the separation of the belt and distributor at the distributor to the height of the bottle to be stoppered.

3 Claims, 2 Drawing Figures

BOTTLE STOPPERING APPARATUS

The present invention pertains to machines for closing glass or plastic bottles with stoppers which are first set onto the bottle opening and are then forced down thereinto.

As an example of this type of machine, one may cite machines for closing mineral water bottles with plastic stoppers. In such machines the bottles are carried on a belt and pass beneath a stopper distributor or delivery device, from the lower end of which each bottle receives a stopper, loosely positioned in the bottle mouth. At a subsequent station the stopper is forced down into the bottle mouth or opening.

Such machines require careful adjustment because, in order for them to operate correctly, it is necessary for the stopper to be correctly centered on the bottle opening as the bottle passes beneath the distributor. Experience shows that for proper operation these machines must be fed with bottles having, to a close tolerance, a uniform height. Even a very small departure of the bottle height from that for which the machine has been constructed and adjusted will result in an incorrect initial position for the stopper on the bottle and hence in a defective closure of the bottle, requiring a slowing or stoppage of the machine.

It is an object of the invention to surmount this shortcoming and to increase the permissible speed of operation of such machines. This result is obtained according to the invention by adding to the machine a device capable of controlling the vertical distance between the bottle carrier and the stoppers as presented by the distributor so as to make this distance always closely equal to the height of the bottle being instantaneously stoppered.

The apparatus according to the invention is advantageously provided with three detectors such as photoelectric cells, disposed a short distance upstream of the distributor along the path of bottle motion. One of these detectors detects the arrival of a bottle to be stoppered and the others detect an excess or deficiency in the height of the bottle by reference to a desired or designed height. These detectors control a servo-mechanism such as a reversible motor which raises or lowers the bottle-carrying belt at the position of its engagement with the distributor or which, in a variant construction, raises or lowers the distributor, in either case to make the separation of the belt and distributor correspond to the height of the bottle about to be stoppered.

BRIEF DESCRIPTION OF THE DRAWINGS

The invention will now be further described in terms of a number of presently preferred exemplary embodiments thereof and with reference to the accompanying drawings in which.

Figure 1:
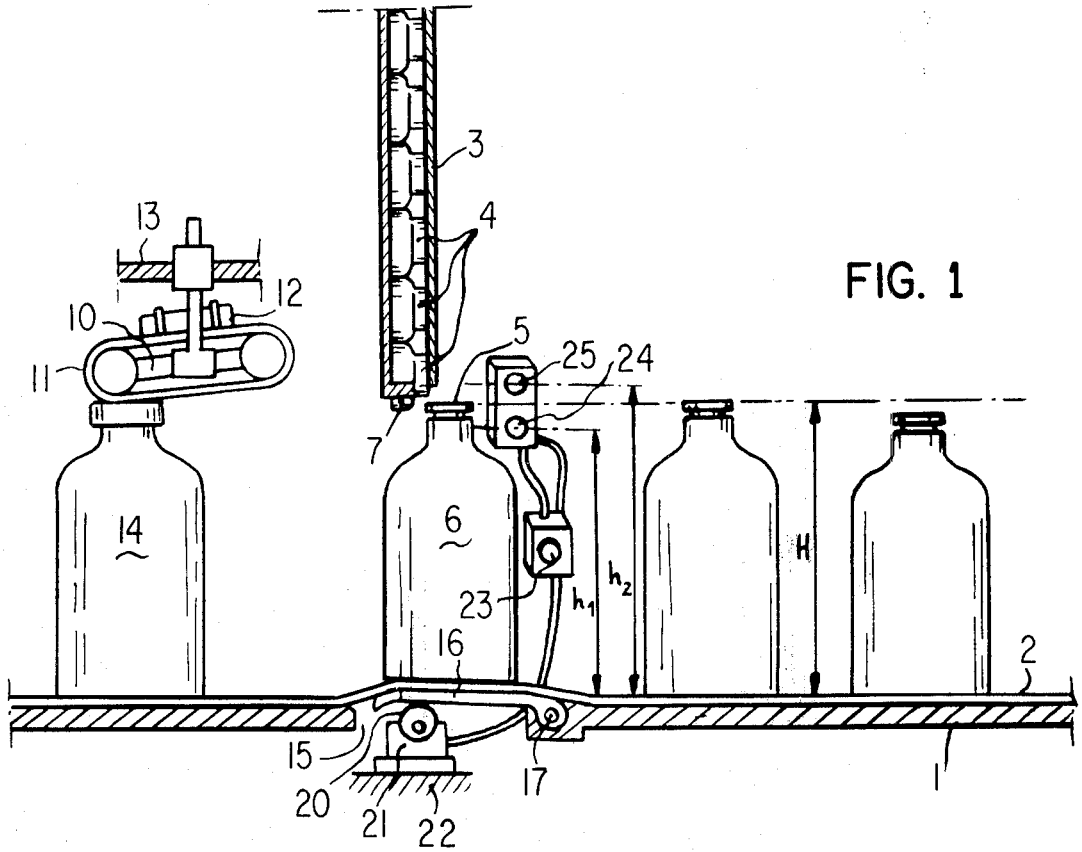
FIG. 1 is a partial schematic view in elevation of a bottle stoppering machine according to the invention.

The machine of the invention illustrated in FIG. 1 comprises a frame 1 over which there passes a travelling belt or conveyor 2. The travelling belt carries the bottles to be stoppered beneath a distributor 3 which contains a supply of stoppers 4 from which the stoppers are delivered one at a time. In proper operation of the machine, the upper rim 5 of each bottle engages, as it passes beneath the distributor, the lower extremity 7 of a stopper protruding from the distributor 3 and carries this stopper off with it, the stopper being aligned vertically in the bottle mouth. The stopper is then forced down into the mouth of the bottle by a driving device generally indicated at 10 which may in and of itself be of known type. The essential element of this driving device is an endless belt 11 driven by a motor 12 of controllable speed.

The support for belt 11 is yieldingly affixed to a member 13, fixed with reference to frame 1. The slope of the belt can be adjusted with respect to the horizontal, and so also can its spacing above the belt 2.

When belt 2 carries the bottle 14 beneath the driving device 10 with a stopper loosely disposed in the bottle opening, the stopper is gradually forced by the belt 11 down into the bottle. The inclination of the belt 11 and its elastic coupling to the frame 13 insure that the stopper will be driven home into the bottle opening whatever the height of the bottle (within wide limits) with respect to the designed or theoretical height therefor, provided only that the stopper be properly though loosely positioned in the opening of the bottle in the first place upon passage of the bottle beneath the distributor 3.

It will be realized however that if the height of the bottle is too much less than the correct value, the bottle will be incapable of picking up a stopper upon passing beneath the distributor. Alternatively, if the bottle is too high, this will either cause the stopper to fall beside the bottle or will improperly position it loosely in the bottle opening. Thus, if the stopper is positioned obliquely in the bottle opening, it may not be correctly driven home as the bottle piece passes beneath the device 10.

Let it be assumed that the designed height for the bottle for optimum operation of the machine is H and that the critical limits on H for correct machine operation are $h_1$ and $h_2$. These three values are shown in FIG. 1.

The apparatus of the invention comprises in an opening 15 in the frame 1 beneath the distributor 4, an oscillating plate 16, articulated with respect to the frame on a horizontal axis at 17. The bottle-carrying belt 2 passes over this oscillating plate.

The approximately horizontal position of the oscillating plate 16 is however subjected to adjustment by operation of an eccentric 20 on which the free end of the plate rests, this eccentric being driven by a servomotor 21 having a reversible direction of rotation and mounted on the frame at 22.

The stoppering machine moreover comprises three detectors 23, 24 and 25. In the example illustrated these are optical, e.g., photoelectric detectors, but they may be of mechanical or hydraulic nature. The detector 23 detects the presence of a bottle within the range of its sensitivity on a portion of frame 1 preceding the opening 15. The detector 24 is excited when the bottle so detected exceeds in height the height $h_1$, and the detector 25 is excited when the bottle so detected is of height greater than $h_2$.

The combination of these detectors is coupled to the servomotor 21 which operates on the height of the plate 16 by operation of the eccentric 20, so as to raise or lower the bottle-carrying belt 2 in the correct sense as to bring the upper portion of the bottle between the levels identified in the figure at the upper ends of the intervals $h_1$ and $h_2$. Servo control apparatus of this kind is well-known and need not be described in detail. In this way the distributor 4 is caused to operate correctly and to position each stopper correctly in the bottle to be closed thereby.

Figure 2:
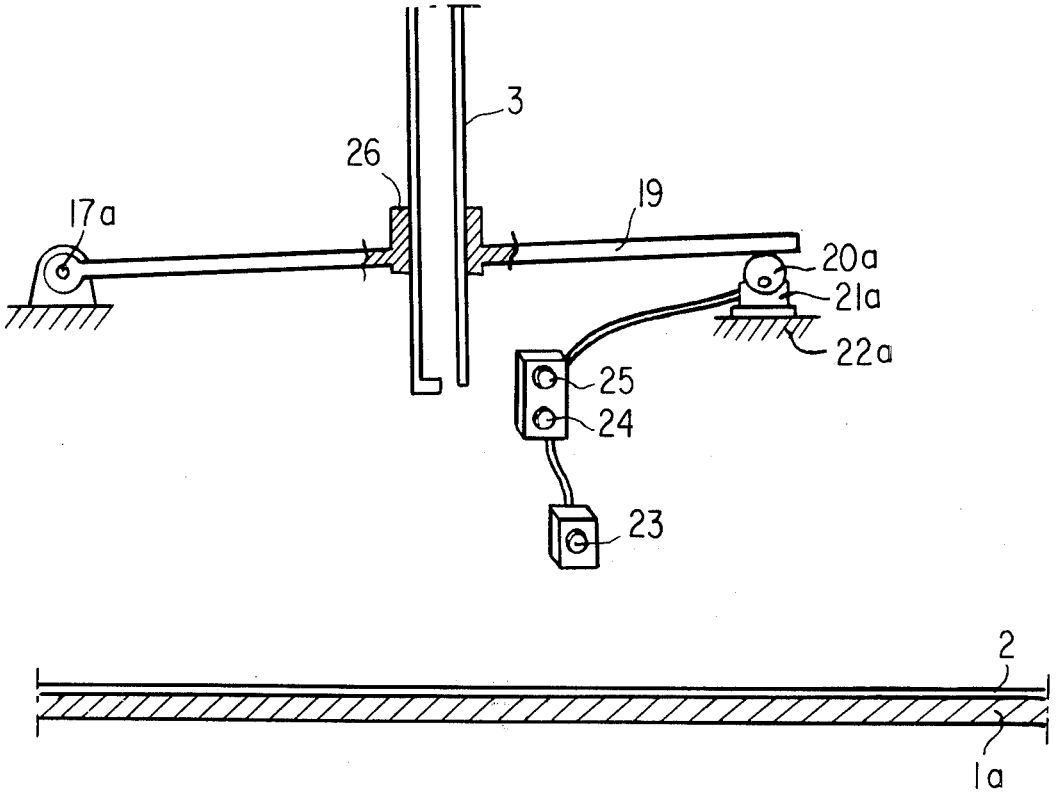
FIG. 2 is a view similar to that of FIG. 1 showing a variant construction.

In the embodiment of the invention diagrammatically illustrated in FIG. 2, the detectors 23, 24 and 25 control a servo system including elements 20*a* and 21*a* like the elements 20 and 21 respectively and mounted at 22*a* in fixed position with respect to the belt support 1. Elements 20*a* and 21 operate on one end of a lever 19, articulated at its opposite end to rotate about an axis 17*a* fixed with respect to the frame. In this embodiment it is the distributor 3 and hence the stoppers which are raised or lowered above the bottle-carrying belt 2 as a function of the height of the individual bottles in order to insure correct placement of the stopper with respect to the bottle. It is to be noted that the spacing between the detectors 24 and 25 is much exaggerated in the drawings. In modern bottle manufacture, especially with plastic bottles, the variation in height of two bottles of a given series is no more than a few tenths of millimeter, so that a range of vertical motion of one millimeter is in general sufficient for the distributor in the case of FIG. 2 or for the bottle-carrying belt 2 in the case of FIG. 1. It is hence easy to find a material for that belt having sufficient flexibility. It may be of textile material, of metal, or of plastic.

It will thus be seen that the invention provides bottle stoppering apparatus including stopper delivery means such as the distributor 3, stopper driving means such as the device 10, means such as the belt 2 to carry bottles in a substantially horizontal direction beneath the delivery and driving means in succession, means such as the detectors 23 to 25 to measure the height of bottles on the carrying means upstream of the delivery means, and means such as the servo-mechanism 20,21 to adjust the vertical separation of the delivery and carrying means as a direct function of bottle height measured.

In a preferred embodiment the measuring means include one detector to detect the approach of a bottle, another to detect insufficient height for the bottle and a third to detect excess height for the bottle. The adjusting means may comprise a servo-mechanism coupled to adjust the vertical position of the carrying means at a location beneath the stopper delivery means. The bottle-carrying means comprise a belt such as the belt 2 and guide means for the belt such as frame 1 having an opening 15 therein, and the adjusting means may then comprise a plate like the plate 16 movably supported within that opening to control the vertical position of the belt, and means coupling the plate to the servo-mechanism. Alternatively, the stopper delivery means may be movably mounted above the bottle-carrying means as illustrated in FIG. 2, and the servo-mechanism may be coupled to the stopper delivery means to raise and lower it above the bottle-carrying means.

In both of the above described embodiments, due to its set-off position and to the shape of the bottles, detector 23 begins and ceases to be excited before detectors 24 and 25 may be excited or de-excited.

Thus, the control device works as follows:

. 23 excited : authorization for 24 and 25. Then :

- 24 excited, but 25 not excited : 16 back to MID - POSITION
- 24 and 25 not excited : 16 UP $h_2 \cdot h_1/2$
- 24 and 25 both excited : 16 DOWN $h_2 \cdot h_1/2$ . 23 not excited : motor 21 deenergized, 16 STEADY.

While the invention has been described hereinabove in terms of a number of presently preferred embodiments thereof, the invention itself is not limited thereto but rather comprehends all modifications of and departures from those embodiments properly falling within the spirit and scope of the appended claims.

I claim:

1. Bottle stoppering apparatus including stopper delivery means, stopper driving means, means to carry bottles in a substantially horizontal direction beneath said delivery and driving means in succession, means including three photoelectric detectors to measure the height of bottles on said carrying means upstream of said delivery means, one of said detectors detecting the approach of a bottle, another detecting insufficient height for the bottle and a third detecting excess height for the bottle, and means to adjust the vertical separation of said delivery and carrying means as a direct function of bottle height measured, said adjusting means comprising a servo-mechanism coupled to adjust the vertical position of said carrying means at a location beneath said delivery means.

2. Apparatus according to claim 1 wherein said carrying means comprise a belt and guide means for the belt having an opening therein, and wherein said adjusting means comprise a plate movably supported within said opening to control the vertical position of said belt, and means coupling said plate to said servo-mechanism.

3. Bottle stoppering apparatus including stopper delivery means, stopper driving means, means to carry bottles in a substantially horizontal direction beneath said delivery and driving means in succession, means movably mounting said delivery means above said carrying means, means including three photoelectric detectors to measure the height of bottles on said carrying means upstream of said delivery means, one of said detectors detecting the approach of a bottle, another detecting insufficient height for the bottle and a third detecting excess height for the bottle, and means to adjust the vertical separation of said delivery and carrying means as a direct function of bottle height measured, said adjusting means comprising a servo-mechanism coupled to said mounting means to adjust the vertical position of said delivery means above said carrying means.

* * * * *